US007629785B1

(12) United States Patent
Drebinger

(10) Patent No.: US 7,629,785 B1
(45) Date of Patent: Dec. 8, 2009

(54) CIRCUIT AND METHOD SUPPORTING A ONE-VOLT BANDGAP ARCHITECTURE

(75) Inventor: Stephan Drebinger, Munich (DE)

(73) Assignee: National Semiconductor Corporation, Santa Clara, CA (US)

( * ) Notice: Subject to any disclaimer, the term of this patent is extended or adjusted under 35 U.S.C. 154(b) by 192 days.

(21) Appl. No.: 11/805,334

(22) Filed: May 23, 2007

(51) Int. Cl.
*G05F 3/20* (2006.01)
*G05F 3/28* (2006.01)

(52) U.S. Cl. ..... 323/313; 323/907

(58) Field of Classification Search ..... 323/311, 323/312, 313, 314, 315, 316, 907; 327/538, 327/539, 540, 541, 543
See application file for complete search history.

(56) References Cited

U.S. PATENT DOCUMENTS

| | | | | |
|---|---|---|---|---|
| 6,294,902 | B1 * | 9/2001 | Moreland et al. | 323/268 |
| 6,426,669 | B1 | 7/2002 | Friedman et al. | |
| 6,954,059 | B1 | 10/2005 | MacLean | |
| 7,053,694 | B2 * | 5/2006 | Ozawa | 327/539 |
| 7,208,930 | B1 * | 4/2007 | Tran et al. | 323/314 |
| 7,224,210 | B2 * | 5/2007 | Garlapati et al. | 327/539 |
| 7,253,597 | B2 * | 8/2007 | Brokaw | 323/314 |

OTHER PUBLICATIONS

Hongchin Lin, et al., "An Area-Efficient CMOS Band-Gap Reference Circuit For Low Supply Voltages", 2002 IEEE, p. 663-666.
Hironori Banba, et al., "A CMOS Band-Gap Reference Circuit with Sub 1V Operation", 1998 Symposium on VLSI Circuits Digest of Technical Papers, p. 228-229.
"LM4140 High Precision Low Noise Low Dropout Voltage Reference", National Semiconductor, Feb. 2005, 15 pages.
A. Cabrini et al., "A 1 V, 26 μW Extended Temperature Range Band-gap Reference in 130-nm CMOS Technology," Proceedings of ESSCIRC, Grenoble, France, 2005 IEEE, pp. 503-506.
Paul Brokaw, "Alternative Bandgaps and Applications," Analog Devices, 3 pages.
Hidehiko Suzuki et al., "System and Method for Minimizing Power Consumption of a Reference Voltage Circuit," U.S. Appl. No. 10/839,726, filed May 5, 2004.
Frank DeStasi, "System and Method for Providing a Low Voltage Bandgap Reference Circuit," U.S. Appl. No. 11/504,976, filed Aug. 16, 2006.
Paul Michael Henry, "System and Method for Providing An Offset Voltage Minimization Circuit," U.S. Appl. No. 11/124,758, filed May 9, 2005.
David J. Megaw, "Circuit and Method for Reducing Reference Voltage Drift in Bandgap Circuits," U.S. Appl. No. 10/924,661, filed Aug. 24, 2004.

* cited by examiner

*Primary Examiner*—Gary L Laxton

(57) ABSTRACT

A system includes a transistor coupled to a voltage rail, a first resistor coupled in series with the transistor, and a second resistor coupled in series with the first resistor. The system also includes a bandgap reference circuit operable to generate a bandgap reference voltage of less than 1.2 volts (such as one volt) between the first and second resistors. The bandgap reference circuit includes a diode configured to generate a complementary-to-absolute-temperature (CTAT) voltage and a third resistor configured to generate a first proportional-to-absolute-temperature (PTAT) voltage using a first current. The bandgap reference circuit also includes a current source configured to sink a CTAT current from the first current to generate a second current and a fourth resistor configured to generate a second PTAT voltage using the second current. A sum of the CTAT voltage, the first PTAT voltage, and the second PTAT voltage is less than 1.2 volts.

20 Claims, 3 Drawing Sheets

CIRCUIT AND METHOD SUPPORTING A ONE-VOLT BANDGAP ARCHITECTURE

TECHNICAL FIELD

This disclosure is generally directed to bandgap circuits and more specifically to a circuit and method supporting a one-volt bandgap architecture.

BACKGROUND

Bandgap circuits are used in many different types of applications to generate stable output voltages across a wide range of temperatures. Bandgap circuits typically use two diodes to generate a proportional-to-absolute-temperature (PTAT) current, and the PTAT current generates a PTAT voltage across a resistor. A voltage across a diode (either one of the diodes used to generate the PTAT current or another diode) is typically complementary-to-absolute-temperature (CTAT), meaning the voltage decreases when the temperature increases and vice versa. The voltage across the diode and the voltage across the resistor collectively represent an output voltage of the bandgap circuit. Bandgap circuits routinely generate a steady, temperature invariant output voltage of around 1.2V.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 5, discussed below, and the various embodiments used to describe the principles of the present invention in this patent document are by way of illustration only and should not be construed in any way to limit the scope of the present invention. Those skilled in the art will understand that the principles of the present invention may be implemented in any type of suitably arranged circuit, device, or system.

Figure 1:
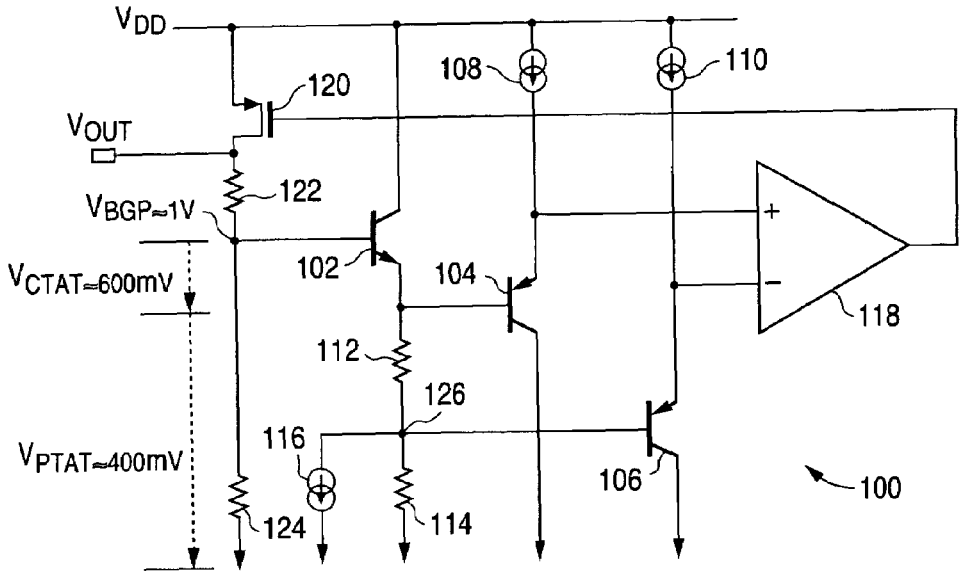
FIG. 1 illustrates an example bandgap reference circuit in accordance with this disclosure.

FIG. 1 illustrates an example bandgap reference circuit 100 in accordance with this disclosure. The embodiment of the bandgap reference circuit 100 shown in FIG. 1 is for illustration only. Other embodiments of the bandgap reference circuit 100 could be used without departing from the scope of this disclosure.

As shown in FIG. 1, the bandgap reference circuit 100 includes three transistors 102-106. The transistor 102 is coupled to a power supply voltage rail that provides a voltage $V_{DD}$. The transistors 104-106 are coupled to current sources 108-110, respectively. In this example, the transistors 102-106 represent bipolar junction transistors. Specifically, the transistor 102 represents an NPN transistor, and the transistors 104-106 represent PNP transistors. The transistors 102-106 may have any suitable size and/or current-handling capacity. For example, the transistor 104 could have an emitter area that is eight times the emitter area of the transistor 106. Also, the transistor 104 could handle eight times the current that can be handled by the transistor 106.

The current sources 108-110 are coupled between the $V_{DD}$ voltage rail and the transistors 104-106. The current sources 108-110 represent any suitable structures operable to provide current to the transistors 104-106. In particular embodiments, the current sources 108-110 are capable of generating equal or approximately equal amounts of current.

As shown here, the collector of the transistor 102 is coupled to the $V_{DD}$ voltage rail. The emitter of the transistor 102 is coupled to the base of the transistor 104. The emitters of the transistors 104-106 are coupled to the current sources 108-110, respectively. The collectors of the transistors 104-106 are coupled to ground. In FIG. 1, the emitter of the transistor 102 and the base of the transistor 104 are also coupled to one end of a resistor 112. The other end of the resistor 112 is coupled to the base of the transistor 106, a resistor 114, and a current source 116.

The transistors 102-106 and the resistors 112-114 in FIG. 1 represent a basic bandgap reference circuit. A base-to-emitter voltage ($V_{BE}$) of the transistor 102 is summed with a PTAT voltage formed across the resistors 112-114. The voltage drop across the resistor 112 may be denoted $\Delta V_{BE}$. Also, the current through the resistor 114 may be denoted I, and the current sinked by the current source 116 may be denoted $I_{CTAT}$. In general, $I_{CTAT}$ equals $V_{BE}/R_{CTAT}$, where $R_{CTAT}$ represents a resistance associated with the generation of $I_{CTAT}$ that varies complementary-to-absolute-temperature.

An error amplifier 118 receives two input voltages and amplifies an error or difference between the input voltages. In this example, the inputs of the error amplifier 118 are coupled to the emitters of the transistors 104-106. The error amplifier 118 includes any suitable structure for receiving inputs and amplifying differences between the inputs. The error amplifier 118 could, for example, represent a folded-cascode amplifier.

An output of the error amplifier 118 is supplied to a transistor 120. In this example, the transistor 120 represents a p-channel metal oxide semiconductor (PMOS) transistor, and the output of the error amplifier 118 is received at the gate of the transistor 120. The transistor 120 couples the $V_{DD}$ voltage rail to a resistor 122, which is coupled in series with a resistor 124. An output voltage $V_{OUT}$ of the bandgap reference circuit 100 is located between the transistor 120 and the resistor 122.

In one aspect of operation, the output voltage $V_{OUT}$ of the bandgap reference circuit 100 can have a temperature-compensated value at or near 1.0V. In contrast, the so-called "magic voltage" of conventional bandgap circuits is typically around 1.2V, meaning the output voltage of the conventional bandgap circuits is typically not lower than 1.2V. As shown in FIG. 1, a bandgap voltage $V_{BGP}$ can be approximately 1.0V, and the minimum output voltage $V_{OUT}$ of the bandgap reference circuit 100 can be approximately equal to the bandgap voltage $V_{BGP}$. The portion of the bandgap voltage $V_{BGP}$ that is PTAT-based is approximately 400 mV, and the portion of the bandgap voltage $V_{BGP}$ that is CTAT-based is approximately 600 mV.

To generate a temperature-invariant voltage smaller than the "magic voltage", the temperature slope of the PTAT voltage is larger than that used in common bandgap circuits. This can be done by subtracting the current $I_{CTAT}$ from the current $I_{PTAT}$ at node 126 in the bandgap reference circuit 100. This leads to a current I having a "super-PTAT" temperature characteristic, which can be expressed as:

$$I=I_{ptat}-I_{ctat}$$

$$\frac{\partial I}{\partial T}=\frac{\partial I_{ptat}}{\partial T}-\frac{\partial I_{ctat}}{\partial T},\ \frac{\partial I_{ptat}}{\partial T}\geq 0,\ \frac{\partial I_{ctat}}{\partial T}\leq 0,\ \frac{\partial I}{\partial T}>>0. \quad (1)$$

This "super-PTAT" current flows through the resistor 114 and generates a voltage drop with the above-proportional positive temperature slope. This compensates for the first-order temperature characteristic of the $V_{BE}$ junction in the transistor 102 with voltage levels in the range of $V_{PTAT}\approx 400$ mV (at room temperature).

In this embodiment, the output voltage $V_{OUT}$ can be expressed as:

$$V_{out}=\left(1+\frac{R_1}{R_2}\right)\cdot\Delta V_{BE}\left(\frac{R}{R_{PTAT}}+1\right)+V_{BE}\left(1-\frac{R}{R_{CTAT}}\right) \quad (2)$$

where R represents the resistance of the resistor 114, $R_{PTAT}$ represents the resistance of the resistor 112, $R_1$ represents the resistance of the resistor 122, and $R_2$ represents the resistance of the resistor 124. Equation (2) can be rewritten as:

$$V_{out}=\left(1+\frac{R_1}{R_2}\right)\cdot\Delta V_{BE}\left(\frac{R}{R_{PTAT}}+1\right)+V_{BE}+I_{CTAT}\cdot R. \quad (3)$$

The first-order temperature behavior of the output voltage $V_{OUT}$ as defined in Equation (2) can be expressed as:

$$\frac{\partial V_{out}}{\partial T}=\left(1+\frac{R_1}{R_2}\right)\cdot\frac{\partial\Delta V_{BE}}{\partial T}\left(\frac{R}{R_{PTAT}}+1\right)+\frac{\partial V_{BE}}{\partial T}\left(1-\frac{R}{R_{CTAT}}\right). \quad (4)$$

If $\Delta V_{BE}$ equals 54 mV, $V_{BE}$ equals 600 mV, $R_{PTAT}$ equals 27 kΩ, $R_{CTAT}$ equals 600 kΩ, R equals 168 kΩ, $R_1$ equals 170 kΩ, and $R_2$ equals 800 kΩ, the following output voltage $V_{OUT}$ can be obtained:

$$V_{out}=\left(1+\frac{170\text{ k}}{800\text{ k}}\right)\cdot 54\text{ mV}\left(\frac{168\text{ k}}{27\text{ k}}+1\right)+600\text{ mV}\left(1-\frac{168\text{ k}}{600\text{ k}}\right) \quad (5)$$

$$V_{out}=\left(1+\frac{170\text{ k}}{800\text{ k}}\right)\cdot 0.822\text{ V}\rightarrow V_{out}=0.996\text{ V}.$$

The first-order temperature behavior of the output voltage $V_{OUT}$ at room temperature can be expressed as:

$$\frac{\partial V_{out}}{\partial T}= \quad (6)$$

$$1.21\cdot\left(200\frac{\mu V}{K}\cdot 7.22+\left(-2\frac{\text{mV}}{K}\right)\cdot 0.72\right)\rightarrow\frac{\partial V_{out}}{\partial T}=4.84\frac{\mu V}{K}\approx 0\frac{\mu V}{K}.$$

In some embodiments, the absolute value of the output voltage $V_{OUT}$ can be trimmed or altered slightly. For example, the resistances in the feedback divider (the pair of resistors 122-124) can be adjusted to trim the output voltage $V_{OUT}$. Moreover, this could be done without affecting the temperature characteristic of the output voltage. As a particular example, the output voltage $V_{OUT}$ could be adjustable down to approximately 900 mV.

Figure 2:
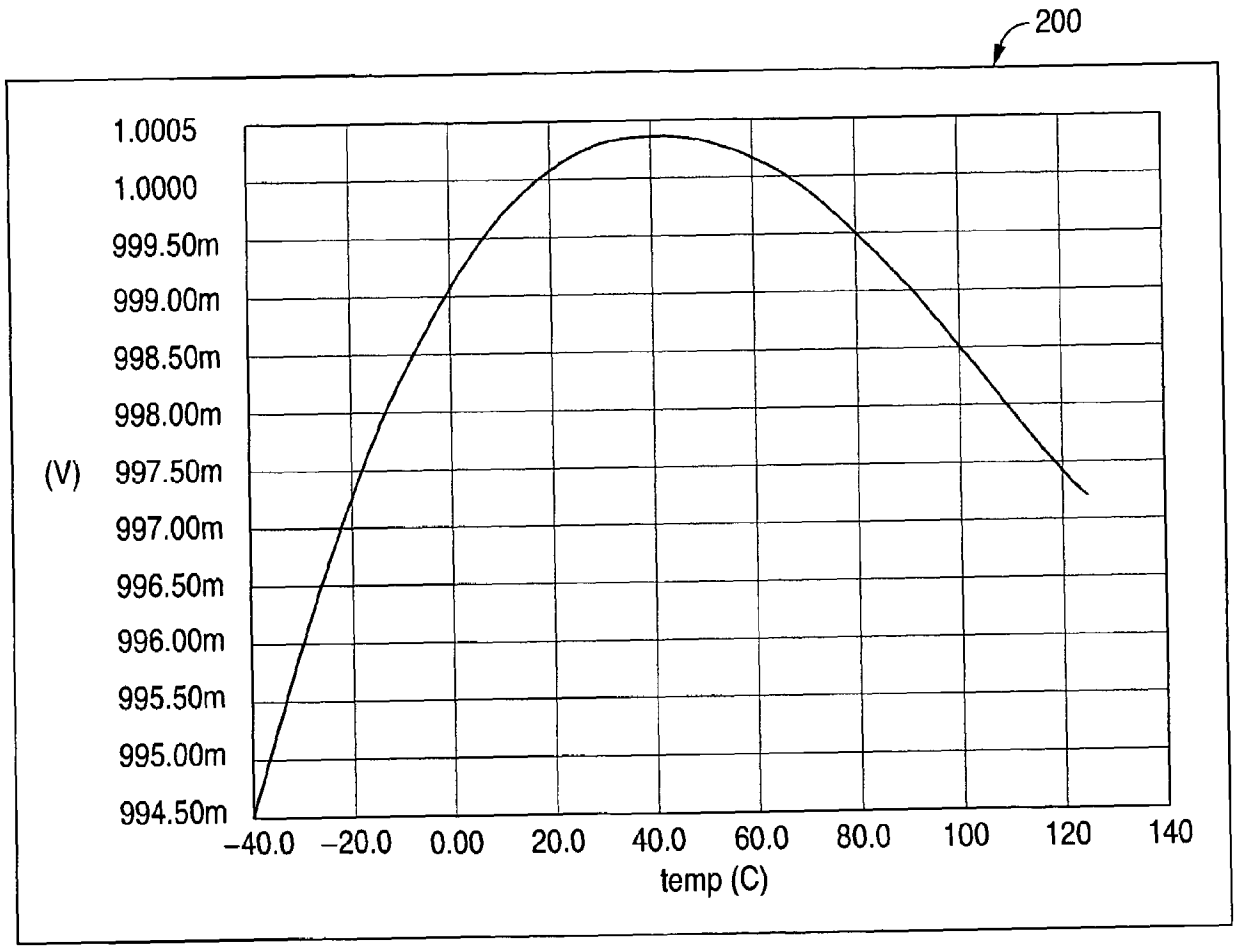
FIG. 2 illustrates an example output voltage of a bandgap reference circuit in accordance with this disclosure.

FIG. 2 illustrates an example output voltage of a bandgap reference circuit in accordance with this disclosure. In particular, FIG. 2 illustrates an example graph 200 plotting the simulated output voltage $V_{OUT}$ produced by the bandgap reference circuit 100 of FIG. 1. The output voltage shown in FIG. 2 is for illustration only. The bandgap reference circuit 100 of FIG. 1 may operate in any other suitable manner without departing from the scope of this disclosure.

The graph 200 in FIG. 2 plots the simulated output voltage $V_{OUT}$ produced by the bandgap reference circuit 100 over a wide temperature range, specifically from −40° C. to +125° C. At the low end of the temperature range, the simulated output voltage $V_{OUT}$ produced by the bandgap reference circuit 100 is approximately 994.5 mV. At the high end of the temperature range, the simulated output voltage $V_{OUT}$ produced by the bandgap reference circuit 100 is approximately 997.2 mV. The output voltage $V_{OUT}$ peaks with a voltage of approximately 1.0004V at a temperature of approximately 40° C. It can be seen here that the output voltage $V_{OUT}$ is very close to 1.0V at normal room temperatures (20-25° C.). For example, the output voltage $V_{OUT}$ is approximately 1.0002V at 25° C.

Figure 3:
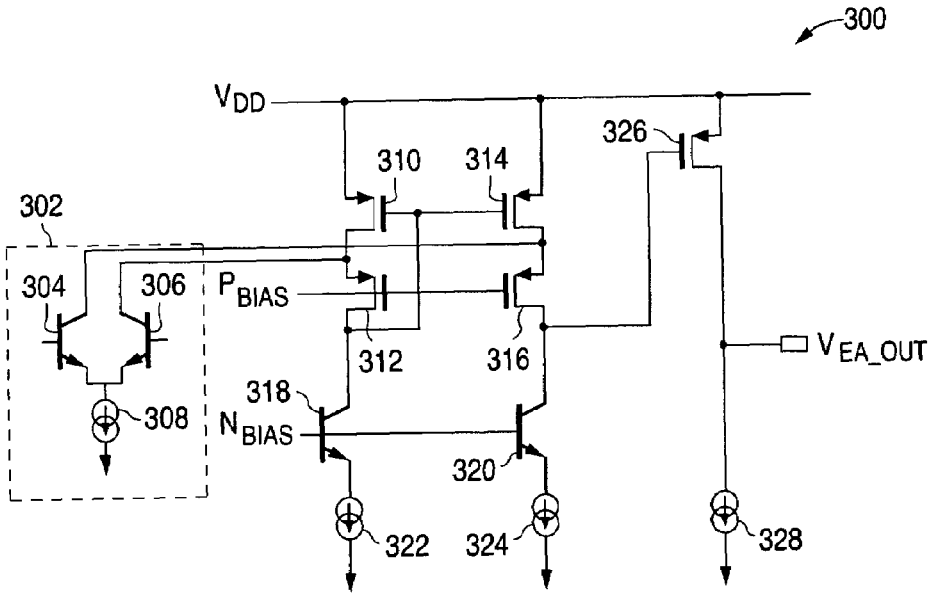
FIG. 3 illustrates an example error amplifier in a bandgap reference circuit in accordance with this disclosure.

FIG. 3 illustrates an example error amplifier 300 in a bandgap reference circuit in accordance with this disclosure. The error amplifier 300 in FIG. 3 could be used, for example, as the error amplifier 118 in the bandgap reference circuit 100 of FIG. 1. The embodiment of the error amplifier 300 in FIG. 3 is for illustration only. Other embodiments of the error amplifier could be used in the bandgap reference circuit 100 without departing from the scope of this disclosure.

As shown in FIG. 3, the error amplifier 300 includes an input stage 302. The input stage 302 receives the inputs of the error amplifier 300 (such as inputs generated between the transistors 104-106 and the current sources 108-110 in FIG. 1). In this example, the error amplifier 300 includes a differential pair of transistors 304-306 and a current source 308. As shown here, the transistors 304-306 represent NPN bipolar junction transistors. The transistors 304-306 have collectors coupled to other portions of the error amplifier 300 and emitters coupled to the current source 308. The transistor 304 has a base that receives a first input (such as by being coupled between the current source 110 and the transistor 106 in FIG. 1), and the transistor 306 has a base that receives a second input (such as by being coupled between the current source 108 and the transistor 104 in FIG. 1).

The error amplifier 300 also includes transistors 310-320. In this example, the transistors 310-316 represent PMOS transistors, and the transistors 318-320 represent NPN bipolar junction transistors. The transistor 310 has a source coupled to the $V_{DD}$ voltage rail and a drain coupled to a source of the transistor 312. The transistor 314 has a source coupled to the $V_{DD}$ voltage rail and a drain coupled to a source of the transistor 316. Gates of the transistors 310 and 314 are coupled to the drain of the transistor 312, and gates of the transistors 312 and 316 are coupled to a bias signal $P_{BIAS}$. Drains of the transistors 312 and 316 are coupled to collectors of the transistors 318 and 320, respectively. Bases of the transistors 318-320 are coupled to a bias signal $N_{BIAS}$, and emitters of the transistors 318-320 are coupled to current sources 322-324, respectively.

The error amplifier 300 further includes a power MOS transistor 326. The power MOS transistor 326 is coupled to a current source 328. In this example, the output voltage $V_{EA_OUT}$ of the error amplifier 300 is formed between the transistor 326 and the current source 328.

Figure 4:
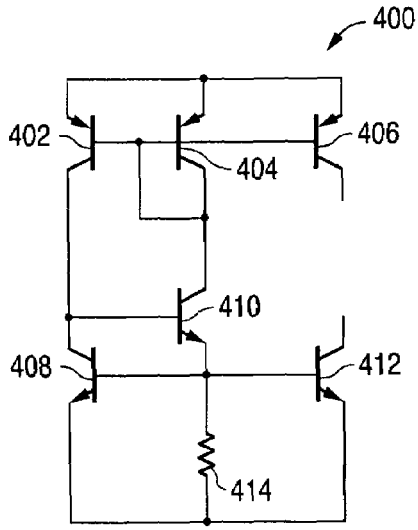
FIG. 4 illustrates an example current source in a bandgap reference circuit in accordance with this disclosure.

FIG. 4 illustrates an example current source 400 in a bandgap reference circuit in accordance with this disclosure. The current source 400 could be used, for example, as the current source 116 in the bandgap reference circuit 100 of FIG. 1. The embodiment of the current source 400 in FIG. 4 is for illustration only. Other embodiments of the current source could be used in the bandgap reference circuit 100 without departing from the scope of this disclosure.

As shown in FIG. 4, the current source 400 includes transistors 402-412 and a resistor 414. In this example, the transistors 402-406 represent PNP bipolar junction transistors, and the transistors 408-412 represent NPN bipolar junction transistors. The emitters of the transistors 402-406 are coupled to one another, and the bases of the transistors 402-406 are coupled to one another and to the collector of the transistor 404. The collector of the transistor 402 is coupled to the collector of the transistor 408 and to the base of the transistor 410. The collector of the transistor 404 is coupled to the collector of the transistor 410. The bases of the transistors 408 and 412 are coupled to the emitter of the transistor 410, and all three are coupled to the resistor 414.

In this example, a reference current from the transistor 402 is forced to flow into the transistor 408. To accomplish this, the transistor 410 supplies enough current into the resistor 414 so that the base-emitter voltage of the transistor 408 equals $V_{BE}$. A CTAT current can then flow out of the transistor 406 (when the current source 400 is sourcing current) or into the transistor 412 (when the current source 400 is sinking current).

The current source 400 shown in FIG. 4 represents a "self-biased" $V_{BE}$ reference circuit. The $V_{BE}$ voltage of the transistor 102 in FIG. 1 and the $V_{BE}$ voltage of the transistor 408 in FIG. 4 may be equal, which can be done if the transistors are similar and have equal current densities. In this case, only the mismatch between the transistors 102 and 408 may affect the output voltage $V_{OUT}$ of the bandgap reference circuit 100. In other words, if the transistors 102 and 408 are laid out close and symmetrically, these transistors may cause roughly no changes in the output voltage $V_{OUT}$. Similarly, if the resistors 112-114 and 414 are built from the same resistor type, only mismatch effects between these resistors may affect the output voltage $V_{OUT}$. Compared to common bandgap structures, the bandgap reference circuit 100 may generate a temperature-compensated voltage lower than the "magic voltage" of 1.2V.

Although FIGS. 1 through 4 illustrate various aspects of one example bandgap reference circuit 100, various changes may be made to FIGS. 1 through 4. For example, other circuitry that implements the functions performed by the bandgap reference circuit 100 of FIG. 1, the error amplifier 300 of FIG. 3, and/or the current source 400 of FIG. 4 could be used. Also, the example output voltage behavior shown in FIG. 2 is for example only, and other embodiments of the bandgap reference circuit 100 could function in other or additional ways.

Figure 5:
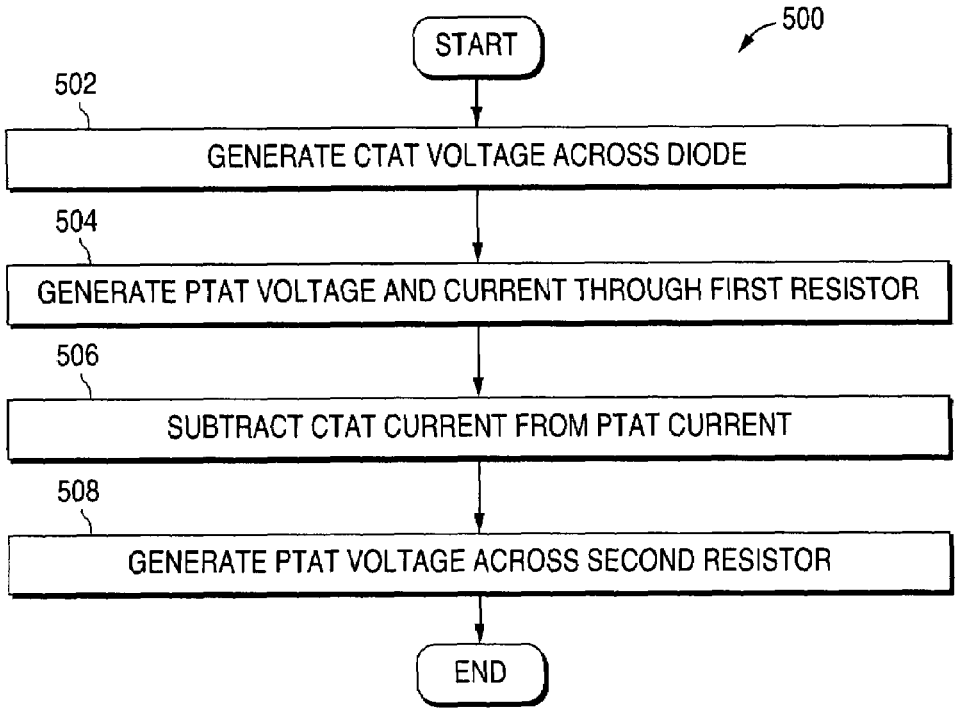
FIG. 5 illustrates an example method for generating an output voltage using a bandgap reference circuit in accordance with this disclosure.

FIG. 5 illustrates an example method 500 for generating an output voltage using a bandgap reference circuit in accordance with this disclosure. The embodiment of the method 500 shown in FIG. 5 is for illustration only. Other embodiments of the method 500 could be used without departing from the scope of this disclosure. Also, for ease of explanation, the method 500 is described with respect to the bandgap reference circuit 100 of FIG. 1. The method 500 could be used by any other suitable circuit, device, or system.

A CTAT voltage is generated across a diode at step 502. This could include, for example, a base-emitter voltage forming across the transistor 102 in the bandgap reference circuit 100. The base-emitter voltage across the transistor 102 could be approximately 600 mV.

A PTAT voltage and a PTAT current are generated across a first resistor at step 504. This could include, for example, generating a PTAT current that flows through the resistor 112 in the bandgap reference circuit 100. The PTAT current flowing through the resistor 112 leads to the generation of a PTAT voltage across the resistor 112.

A CTAT current is subtracted from the PTAT current at step 506. This could include, for example, sinking the CTAT current from the node 126 in the bandgap reference circuit 100 using the current source 116. This subtracts the CTAT current from the PTAT current that flows through the resistor 112.

A PTAT voltage is generated across a second resistor at step 508. This could include, for example, allowing the "super-PTAT" current (the PTAT current from step 504 with the CTAT current removed during step 506) to flow through the resistor 114, leading to the generation of the second PTAT voltage across the resistor 114. The combined PTAT voltages across the first and second resistors in steps 504 and 508 could equal approximately 400 mV. The combined CTAT and PTAT voltages generated during the method 500 therefore equals approximately one volt.

Although FIG. 5 illustrates one example of a method 500 for generating an output voltage using a bandgap reference circuit, various changes may be made to FIG. 5. For example, while shown as a series of steps, various steps in FIG. 5 could overlap or occur in parallel.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A method comprising:

generating a complementary-to-absolute-temperature (CTAT) voltage;

generating a first proportional-to-absolute-temperature (PTAT) voltage across a first resistor using a first current;

removing a CTAT current from the first current to generate a second current; and generating a second PTAT voltage across a second resistor using the second current;

wherein a sum of the CTAT voltage, the first PTAT voltage, and the second PTAT voltage is less than 1.2 volts.

2. The method of claim 1, wherein:

generating the CTAT voltage comprises using a transistor;

the first resistor is coupled in series with the transistor; and the second resistor is coupled in series with the first resistor.

3. The method of claim 2, wherein removing the CTAT current from the first current comprises sinking the CTAT current from a node located between the first and second resistors.

4. The method of claim 2, wherein:

generating the CTAT voltage comprises using a first transistor; and further comprising generating currents through a second transistor and a third transistor, the second transistor coupled between the first transistor and the first resistor, the third transistor coupled between the first and second resistors.

5. The method of claim 4, further comprising:

generating an output voltage of approximately one volt between a fourth transistor and a third resistor, the fourth transistor coupled in series with the third resistor, the third resistor coupled in series with a fourth resistor, the third and fourth resistors coupled to the first transistor.

6. The method of claim 5, wherein the output voltage remains within 0.2 millivolts of one volt between 20-25° C.

7. The method of claim 1, wherein:

the CTAT voltage equals approximately 600 millivolts; and the first and second PTAT voltages collectively equal approximately 400 millivolts.

8. A circuit comprising:

a p-n junction configured to generate a complementary-to-absolute-temperature (CTAT) voltage;

a first resistor configured to generate a first proportional-to-absolute-temperature (PTAT) voltage using a first current;

a current source configured to sink a CTAT current from the first current to generate a second current; and a second resistor configured to generate a second PTAT voltage using the second current;

wherein a sum of the CTAT voltage, the first PTAT voltage, and the second PTAT voltage is less than 1.2 volts.

9. The circuit of claim 8, wherein:

the p-n junction comprises a transistor;

the first resistor is coupled in series with the transistor; and the second resistor is coupled in series with the first resistor.

10. The circuit of claim 9, wherein the current source is configured to remove the CTAT current from the first current by sinking the CTAT current from a node located between the first and second resistors.

11. The circuit of claim 9, wherein:

the p-n junction comprises a first transistor; and the circuit further comprises a second transistor and a third transistor, the second transistor coupled between the first transistor and the first resistor, the third transistor coupled between the first and second resistors.

12. The circuit of claim 11, further comprising:

a fourth transistor;

a third resistor coupled in series with the fourth transistor; and a fourth resistor coupled in series with the third resistor, the third and fourth resistors coupled to the first transistor;

wherein an output voltage of approximately one volt is generated between the fourth transistor and the third resistor.

13. The circuit of claim 12, wherein the output voltage remains within 0.2 millivolts of one volt between 20-25° C.

14. The circuit of claim 8, wherein:

the CTAT voltage equals approximately 600 millivolts; and the first and second PTAT voltages collectively equal approximately 400 millivolts.

15. A system comprising:

a first transistor coupled to a voltage rail;

a first resistor coupled in series with the first transistor;

a second resistor coupled in series with the first resistor; and a bandgap reference circuit operable to generate a bandgap reference voltage of less than 1.2 volts between the first and second resistors, wherein the bandgap reference circuit comprises:

a second transistor configured to generate a complementary-to-absolute-temperature (CTAT) voltage;

a third resistor configured to generate a first proportional-to-absolute-temperature (PTAT) voltage using a first current;

a current source configured to sink a CTAT current from the first current to generate a second current; and a fourth resistor configured to generate a second PTAT voltage using the second current;

wherein a sum of the CTAT voltage, the first PTAT voltage, and the second PTAT voltage is less than 1.2 volts.

16. The system of claim 15, wherein:

the bandgap reference circuit further comprises a third transistor and a fourth transistor, the third transistor coupled between the second transistor and the third resistor, the fourth transistor coupled between the third and fourth resistors.

17. The system of claim 16, wherein the bandgap reference circuit further comprises:

a first current source coupled to the third transistor; and a second current source coupled to the fourth transistor.

18. The system of claim 15, wherein an output voltage is generated between the first transistor and the first resistor.

19. The system of claim 18, wherein the output voltage remains within 0.2 millivolts of one volt between 20-25° C.

20. The system of claim 18, wherein the output voltage remains within 1 millivolt of one volt between 0-90° C.

* * * * *